US006120330A

United States Patent [19]

Gwiazdowski

[11] Patent Number: 6,120,330

[45] Date of Patent: Sep. 19, 2000

[54] ARRANGEMENT OF CONTACT PAIRS FOR COMPENSATING NEAR-END CROSSTALK FOR AN ELECTRIC PATCH PLUG

[75] Inventor: Michael Gwiazdowski, Berlin, Germany

[73] Assignee: Krone GmbH, Berlin-Zehlendorf, Germany

[21] Appl. No.: 09/204,705

[22] Filed: Dec. 3, 1998

[30] Foreign Application Priority Data

May 20, 1998 [DE] Germany ..... 198 22 630

[51] Int. Cl.[7] ..... H01R 24/00

[52] U.S. Cl. ..... 439/676

[58] Field of Search ..... 439/676, 941

[56] References Cited

U.S. PATENT DOCUMENTS

| | | | |
|---|---|---|---|
| 3,761,842 | 9/1973 | Gandrud | 439/941 |
| 5,310,363 | 5/1994 | Brownell et al. . | |
| 5,362,257 | 11/1994 | Neal | 439/676 |
| 5,586,914 | 12/1996 | Foster, Jr. et al. | 439/676 |
| 5,647,770 | 7/1997 | Belopolsky | 439/676 |
| 5,779,503 | 7/1998 | Tremblay et al. | 439/676 |
| 5,911,602 | 6/1999 | Vaden | 439/676 |

FOREIGN PATENT DOCUMENTS

| | | |
|---|---|---|
| 0 525 703 A1 | 2/1993 | European Pat. Off. . |
| 0 598 192 A1 | 5/1994 | European Pat. Off. . |
| 0 601 829 A2 | 6/1994 | European Pat. Off. . |
| 0 692 884 A1 | 1/1996 | European Pat. Off. . |
| 0 782 221 A2 | 7/1997 | European Pat. Off. . |
| WO 94/06216 | 3/1994 | WIPO . |
| WO 97/19499 | 5/1997 | WIPO . |
| WO 97/44862 | 11/1997 | WIPO . |
| WO 98/04020 | 1/1998 | WIPO . |

OTHER PUBLICATIONS

German Search Report, Feb. 9, 1999.

*Primary Examiner*—Lincoln Donovan
*Assistant Examiner*—Javaid Nasri
*Attorney, Agent, or Firm*—McGlew and Tuttle, P.C.

[57] ABSTRACT

An arrangement of contact pairs (1, 2; 3, 6; 4, 5; 7, 8; 201, 202; 203, 206; 204, 205; 207, 208) for an electric patch plug for compensating the near-end crosstalk with contact pairs interlaced with one another, especially for an RJ-45 patch plug, in which the contacts (4, 5) are crossed for compensation. The crossing point (11) is placed in the elastically mounted part of the contacts (1, 2; 3, 6; 4, 5; 7, 8) of the socket.

19 Claims, 7 Drawing Sheets

ARRANGEMENT OF CONTACT PAIRS FOR COMPENSATING NEAR-END CROSSTALK FOR AN ELECTRIC PATCH PLUG

FIELD OF THE INVENTION

The present invention pertains to an arrangement of contact pairs for compensating the near-end crosstalk for an electric patch plug.

BACKGROUND OF THE INVENTION

Due to a magnetic and electric coupling between two contact pairs, a contact pair induces a current or influences electric charges in adjacent contact pairs, so that side-to-side crosstalk occurs. To avoid the near-end crosstalk, the contact pairs may be arranged at very widely spaced locations from one another, or a shielding may be arranged between the contact pairs. However, if the contact pairs must be arranged very close to one another for design reasons, the above-described measures cannot be carried out, and the near-end crosstalk must be compensated.

The electric patch plug used most widely for symmetric data cables is the RJ-45 patch plug, which is known in various embodiments, depending on the technical requirement. Prior-art RJ-45 patch plugs of category 5 have, e.g., a side-to-side crosstalk attenuation of>40 dB at a transmission frequency 100 MHz between all four contact pairs. Based on the unfavorable contact configuration in RJ-45, increased side-to-side crosstalk occurs due to the design. This occurs especially in the case of the plug between the two pairs 3, 6 and 4, 5 because of the interlaced arrangement (e.g. EIA/TIA 568A and 568B). This increased side-to-side crosstalk limits the use at high transmission frequencies. However, the contact assignment cannot be changed for reasons of compatibility with the prior-art plugs. Due to this unfavorable design arrangement, special measures are needed even to reach a near-end crosstalk of>40 dB at 100 MHz of category 5. All prior-art measures leave the plug unaffected and bring about the improvement in near-end crosstalk by compensatory measures in the socket (jack).

The crossing of a pairs (pairs of conductive paths) has been used. As a result of this side-to-side crosstalk, an antiphase is generated behind the crossed area. This is also described as balancing the circuits. The conductive path of each transmission line connecting to the jack/plug (e.g. two conductive paths per transmission line—a pair) that is furthest from the adjacent pair in the jack/plug is brought together with the conductive path of that adjacent pair which is closest (a twist of the initial position). This use of conductive paths (e.g. in a circuit board) balances the reactive effect of pair interaction at the jack/plug. Crossing of the two lines 4 and 5 is described in this connection in EP 0 525 703 A1, and the crossing of the two lines 3 and 6 in WP 94/06216. The twisting of leads of different pairs has also been known from EP 0 601 829 A2. The compensation by direct auxiliary capacitances to the contact after next can be found in EP 0 692 884 A1. A solution for compensation by extended and multiply bent contacts to their crossing is described in EP 0 598 192 A1, where the compensation is generated behind the crossing by the continued contacts and insulation displacement terminals.

Compensation measures in the socket (jack) are a common feature of all the prior-art solutions, but the distance between the side-to-side crosstalk area and the effective compensation area is too great. To achieve the spring forces of the jack/socket and to securely lead the mobile contacts in the socket these contacts are made relatively long. This entails a compensation region—a crossing on a printed circuit board, on the extended stationary contacts or twisted terminal leads—used at far too great a distance. The gain from these prior-art compensation measures is therefore limited, so that patch plugs for 200 MHz cannot be prepared according to these prior-art solutions, because the near-end crosstalk cannot be sufficiently compensated at higher frequencies.

SUMMARY AND OBJECTS OF THE INVENTION

The basic technical problem to be solved by the present invention is therefore to provide an arrangement of contact pairs for an electric patch plug (jack/plug) with at least two contact pairs interlaced with one another, especially for an RJ-45 patch plug, for higher transmission frequencies with sufficient side-to-side crosstalk attenuation. Another technical problem to be solved is to provide an electric patch plug for high transmission frequencies, which is downward compatible with the prior-art category 5 patch plugs.

According to the invention, an arrangement of contact pairs for a socket (jack) of an electric patch plug is provided with at least two contact pairs interlaced with one another. This is particularly an RJ-45 patch plug, wherein the contacts can be arranged partially in a fixed manner toward the terminal area and elastically in a socket body toward the contact area. At least two contacts of the contact pairs which are interlaced with one another are crossed (the initial position is changed). The crossing point of the contacts is located in the elastically mounted partial area of the said contacts.

Due to the crossing point being arranged in the elastically mounted part of the contact of the socket, the site of the physical location of the compensation is displaced into the vicinity of the site where the near-end crosstalk is generated, namely, the contact area, so that considerably higher cutoff frequencies can be reached. The tolerances occurring due to the assembly of the wires is reduced due to the decoupled position of the contacts in the terminal area of the plug to the extent that higher transmission frequencies can be reached in conjunction with the arrangement of the contacts for the socket, but the arrangement is still also compatible with category 5.

In another preferred embodiment, the crossing point is placed directly behind the contact area, which brings about a minimal distance between the side-to-side crosstalk zone and the compensation zone, so that phase shifts due to run times are negligible.

In another preferred embodiment, the contacts of the contact pairs interlaced with one another are led in parallel in the contact area, wherein the inner contacts are directed in opposite directions to the outer contacts, which brings about a decoupling of the current-carrying partial areas of the inner contacts. Adjoining this area, the inner contacts are crossed and bent by 180° and are again led in parallel to the first partial area. This causes the side-to-side crosstalk generated to change its sign directly behind the crossing point and compensation of the side-to-side crosstalk from the contact area to take place.

To generate the sufficient spring forces, the contacts of the contact pairs interlaced with one another are bent at an acute angle in the adjoining area and are led in parallel to a terminal area. For decoupling and consequently for limiting the compensation area, the inner contacts are once again bent away from the outer contacts before the terminal area and are again led in parallel to the outer contacts.

To reduce the side-to-side crosstalk from the outer contacts of the contact pairs interlaced with one another to the non-interlaced contact pairs, the latter are led in opposite directions in parallel to the inner contacts in the contact area bent into a decoupled position, and are subsequently led in parallel to the contacts of the contact pairs interlaced with one another to the terminal area.

To improve the compensation gain, the side-to-side crosstalk is deliberately selected to be greater in the plug and is subsequently again compensated, and the compensation zone is divided into two partial areas, namely, a compensation zone in the socket and a compensation zone at the terminal area of the plug, for which purpose the inner contacts are likewise crossed.

In another preferred embodiment, the inner contacts are made with a lower line impedance in the compensation zone of the plug than in the side-to-side crosstalk zone, so that a predominantly capacitive coupling, which compensates the predominant component of the capacitive coupling in the area of the plug/socket transition, where the non-current-carrying contacts of the socket and plug act capacitively, takes place between the contacts of the contact pairs interlaced with one another.

The outer, non-interlaced contact pairs are led in parallel to one another, and they are led in opposite directions in the contact area for decoupling from the contacts of the contact pairs interlaced with one another. For better decoupling from the contacts of the socket, the outer contacts have a recess adjoining the contact area.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
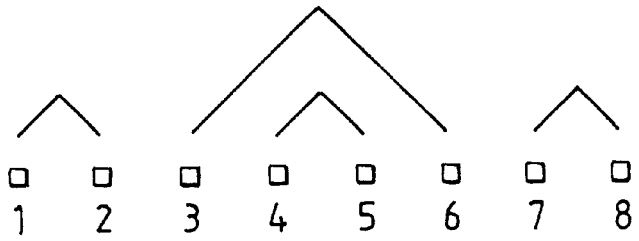
FIG. 1 is a contact arrangement of an RJ-45 patch plug (a known standard)
Figure 2:
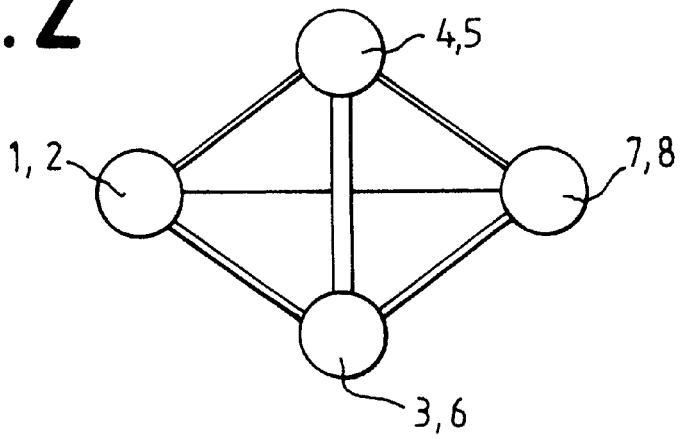
FIG. 2 is a representation of the couplings occurring in the case of an arrangement according to FIG. 1.

Referring to the drawings in particular, FIG. 1 shows the pin configuration for an RJ-45 patch plug (this crresponds e.g. to EIA/TIA 568A and 568B). The RJ-45 patch plug comprises four contact pairs 1, 2; 3, 6; 4, 5; 7, 8. The contacts of one contact pair that belong to one another are therefore not always located directly next to one another, but the two middle contact pairs 3, 6 and 4,5 are interlaced with one another. That is, the contact pair 4, 5 has a contact 3 of the pair 3, 6 on one side and a contact 6 of the pair 3, 6 on the other side. The consequence of this is an especially strong side-to-side crosstalk. In the case of four contact pairs, there are six couplings between the contact pairs, which are schematically represented in FIG. 2, where the thickness of the line symbolizes the intensity of the coupling.

Since the solutions suggested to date are only compensatory measures in the socket (jack) which reduce the side-to-side crosstalk and maintain the side-to-side crosstalk in the plug, the side-to-side crosstalk in the plug cannot be reduced as desired to improve the patch plug for reasons of the desired downward compatibility with category 5 patch plugs. The improvements are therefore to be performed primarily in the socket (jack). Only individual measures will be described below, all of which are important for the present invention both individually and jointly.

Figure 3:
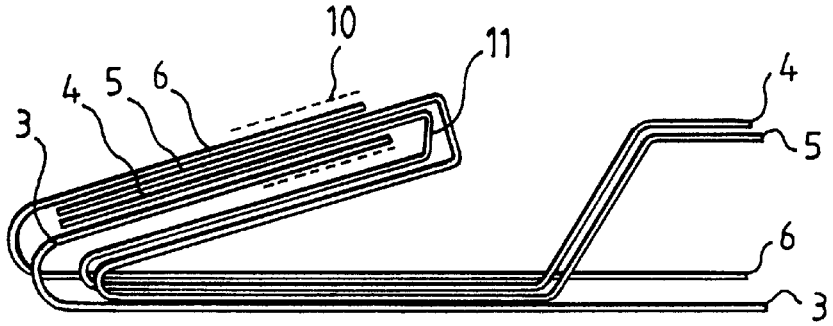
FIG. 3 is a perspective view of the contact pairs interlaced with one another for an RJ-45 socket (jack)

FIG. 3 shows a perspective view of the middle contact pairs 3, 6 and 4, 5 interlaced with one another. To improve the compensation gain in the socket (jack), the distance between the contact area 10, where the contacts of the plug contact those of the socket (jack), and the compensation area is reduced. To do so, the crossing of the contacts 4 and 5 (which crossing fundamentally known for use in other locations—e.g. in circuit boards or with leads) is provided at a mobile part (elastic area) of the contacts of the socket (jack). As is apparent from FIG. 3, the crossing 11 takes place directly adjoining the contact area 10, wherein the compensation area joins directly behind the crossing 11.

Figure 4:
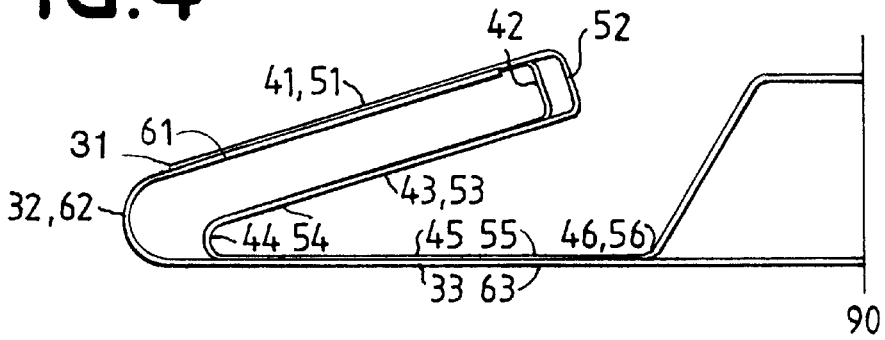
FIG. 4 is a side view of the arrangement according to FIG. 3.

The mode of operation of the compensation of the contact arrangement according to FIG. 3 will now be explained in greater detail on the basis of FIG. 4, which shows a side view of FIG. 3. The contacts 3 and 6 of the spread pair (pair 3, 6) are parallel and have a completely identical design; they lead away to the left from the contact area 10 in a first partial area 31, 61, pass over into a straight part 33, 63 after a bend 32, 62 and end on the right in FIGS. 3, 4 and 5 in a terminal area 90, which may be, e.g., a printed circuit board.

The contacts 4 and 5 of the middle pair extend in parallel to the contact 3 and 6 in the contact area 41, 51 and lead away to the right in the opposite direction and make a 180° bend 42, 52, where the two contacts cross, i.e., when viewed from the top, contact 4 occupies the place of contact 5 and contact 5 that of contact 4. After the crossing 11, the two contacts 4 and 5 extend in parallel to one another and in parallel to the contact sections 31 and 61. After another bend 44, 54, the contacts 4 and 5 are in the same plane as 3 and 6.

The compensation begins directly behind the crossing 11 or bend 42, 52 due to the contact areas 31, 61, 43, 53 being in parallel as well as the parallel run partial area 33, 63, 45, 55 being parallel. To limit the compensation area, the two contacts 4 and 5 leave the compensation zone with a bend 46, 56, and end decoupled in the terminal area 90.

To obtain the necessary spring forces, the contact sections 31, 32 and 41, 42, 43, 44 and 51, 52, 53, 54 and 61, 62 are mobile and part of the mobile part, while the others are located stationarily in the socket (jack). By shifting the crossing 11 into the mobile part of the contacts, the side-to-side crosstalk area and the compensation are very close to one another.

Due to the contacts being continued in opposite directions from the contact area, the contacts 3 and 6 to the left and the contacts 4 and 5 to the right, the side-to-side crosstalk is limited in the contact area 31, 41, 51, 61 to the electrical components, because the currents flowing in opposite directions hardly influence one another here.

Figure 5:
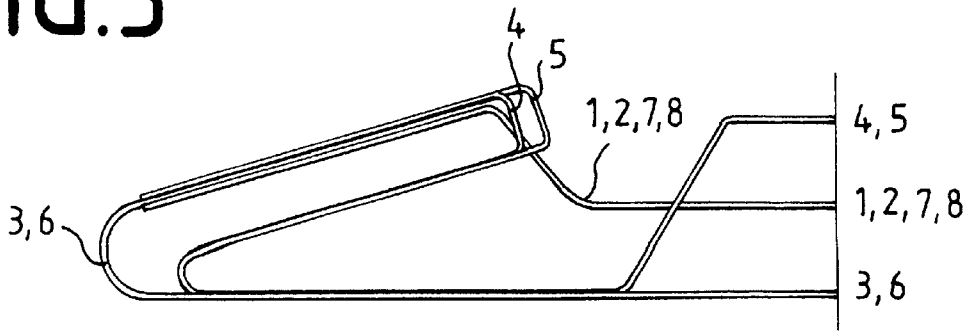
FIG. 5 is a side view of the four contact pairs for an RJ-45 socket (jack)

FIG. 5 shows the complete contact arrangement for the socket (jack) of an RJ-45 patch plug according to the invention. No specific compensation is needed in the socket (jack) for optimizing the side-to-side crosstalk to the outer contact pairs 1, 2 and 7, 8 to achieve the category 5 compatibility. The side-to-side crosstalk to the outer pairs is therefore minimized. To reduce the side-to-side crosstalk in the contact area of the socket (jack) between the contacts 3 and 1, 2 as well as 6 and 7, 8, the contacts 1, 2, 7, 8 extend in the opposite direction compared with the adjacent contacts 3, 6. The outer contact pairs 1, 2 and 7, 8 are continued at one level between the two pairs 3, 6 and 4, 5.

Based on the compatibility requirement, a corresponding side-to-side crosstalk must be maintained between the pairs 3, 6 and 4, 5 in an improved plug according to the invention. Relatively great tolerances occur in side-to-side crosstalk in the case of the prior-art, usual direct assembly of the leads at the contacts in prior-art category 5 plugs, depending on the position of the leads, but this is still sufficient for meeting the category 5 values. Some improvements must still be made in the plug for using the plug at even higher frequencies.

Figure 6:
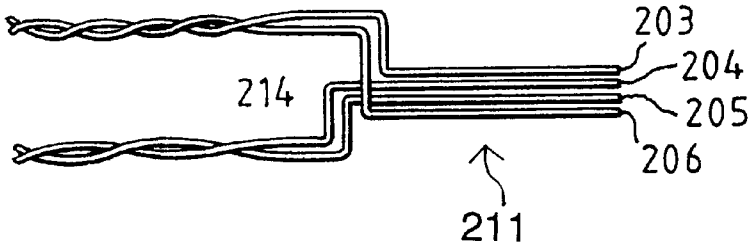
FIG. 6 is a schematic representation of the contact pairs interlaced with one another in the terminal area for an RJ-45 plug.

FIG. 6 shows a top view of the contacts 203, 206; 204, 205 of the contact pairs interlaced with one another. The contacts 203, 204, 205, 206 extend completely in parallel to one another. The contacts 204, 205 as well as 203, 206 are pulled apart only in the terminal area 214, so that the contact pairs are extensively decoupled in the terminal area 214 because of the distance between these contact pairs. As is shown in FIG. 6, this can be achieved by bending off the contact pairs in opposite directions or by simply bending off one contact pair. The mode of operation of the contact arrangement of the improved plug consists of limiting the currently usual great tolerances in side-to-side crosstalk and to set the side-to-side crosstalk at a lower tolerance value that still satisfies category 5 and is coordinated with the compensation in the socket (jack) as described above. The setting of the side-to-side crosstalk at a defined value is performed by means of contacts placed firmly in a plastic body, which extend in parallel to generate the needed side-to-side crosstalk. To extensively limit cable effects when connected to the contacts, the contacts are first pulled apart to clearly limit the side-to-side crosstalk zone and the leads are assembled in a nearly decoupled position. Undefined positions of the leads as a consequence of untwisting thus hardly affect the side-to-side crosstalk values.

Together with the above-described socket (jack), such a plug leads to considerably better values for near-end crosstalk at higher transmission frequencies, which were also confirmed by measurements. To further improve the frequency response, the side-to-side crosstalk in the plug is deliberately selected to be higher between the contact pairs 203, 206 and 204, 205 and is again corrected by a subsequent compensation. The compensation is now selected to be such that the plug will again deliver the necessary values for category 5. Before describing the implementation in the contact arrangement, the underlying principle of action shall be explained in greater detail. Together with the above-described contact arrangement for the socket (jack), the entire patch plug (plug and socket) behaves like a side-to-side crosstalk zone with two compensation zones, namely, one in the socket (jack) and one in the plug, which leads to a markedly better compensation gain than a single compensation, which will be explained below on the basis of a single arrangement of two coupled double lines in FIGS. 7*a–c*.

Figure 7A:
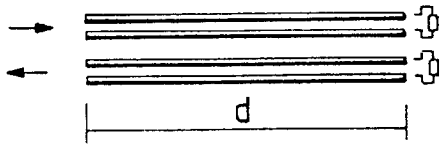
FIG. 7*a* is a model of two homogeneous lines for near-end crosstalk.
Figure 7B:
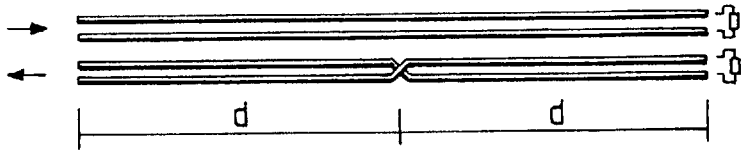
FIG. 7*b* is a model according to FIG. 7*a* with single compensation.

The near-end crosstalk between parallel, homogeneous lines according to FIG. 7*a* increases up to a certain limit at a rate of 20 dB/decade, i.e., it behaves like a first-order high-pass filter. If this side-to-side crosstalk is compensated, e.g., by a second line section according to FIG. 7*b*, for which purpose one line pair was crossed, a limiting curve is obtained for the near-end crosstalk in the case of optimal compensation, which increases at a rate of 40 dB/decade. This limiting curve is clearly explained by the mean distance d between the side-to-side crosstalk zone and the compensation zone, so that the signal flowing over the compensation zone has a run time greater by twice the distance d. This leads to an additional, frequency-dependent phase shift, which brings about a deviation from the desired 180° to extinguish the side-to-side crosstalk. A distance of $d=\lambda/4$ (where $\lambda$ is the wavelength) already brings about an additional phase reversal because of the double path length, so that the resulting side-to-side crosstalk occurring in this case is twice that of the uncompensated side-to-side crosstalk zone. A closer scrutiny leads to the result that a gain from such a compensation is present in the case of a distance of $d<\lambda/12$ only.

One tenth of this distance, e.g., about $d=\lambda/120$, is needed for a compensation gain of 20 dB. Depending on the material of the surrounding plastic, a wavelength of about 1 m is obtained for a frequency of 200 MHz, i.e., a distance d of about 8 mm is needed for this. The example shows how the dimensions of the patch plug determine the limits of the compensation. A dimension of 8 mm can hardly be undercut in the RJ-45 patch plug for mechanical reasons; moreover, a gain of 20 dB is not sufficient.

Figure 7C:
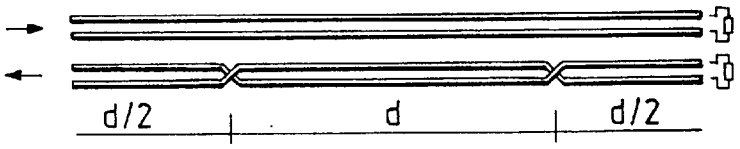
FIG. 7*c* is a model according to FIG. 7*a* with double compensation.
Figure 8:
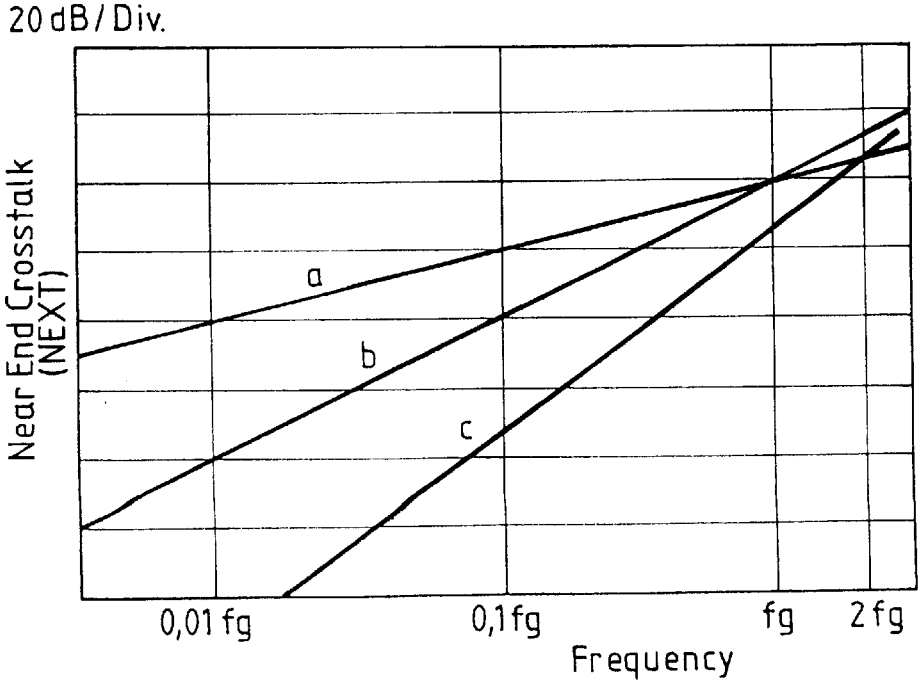
FIG. 8 is frequency curves of the models according to FIGS. 7*a–c;*

If the compensation area is divided into two equal parts and these are placed before and behind the side-to-side crosstalk area, an arrangement according to FIG. 7*c* is obtained. Two compensation signals, whose mean run time is identical to the mean run time in the side-to-side crosstalk zone, are obtained due to the division. Thus, there is no frequency-dependent phase shift any more, and the phase difference between the side-to-side crosstalk signal and the compensation signal remains 180°, assuming a symmetrical design. As a result, markedly better values are obtained for the compensation gain. A limiting curve of the near-end crosstalk of 60 dB/decade can be reached for an exact compensation. This limit is clearly due to the fact that the amount of the compensation decreases as a consequence of the geometric separation of the two compensations at the high frequencies. If the distance between the two compensations is 1.5 $d=\lambda/4$, i.e., $d=\lambda/6$, the two will have opposite signs, and the compensation is ineffective. The limiting frequency at which the compensation becomes ineffective is twice that for the single compensation. Together with the higher slope of the near-end crosstalk curve, the gain of this type of compensation can be recognized from FIG. 8. The frequency curves in FIG. 8 were able to be confirmed by measurement with a four-lead ribbon cable.

Figure 9:
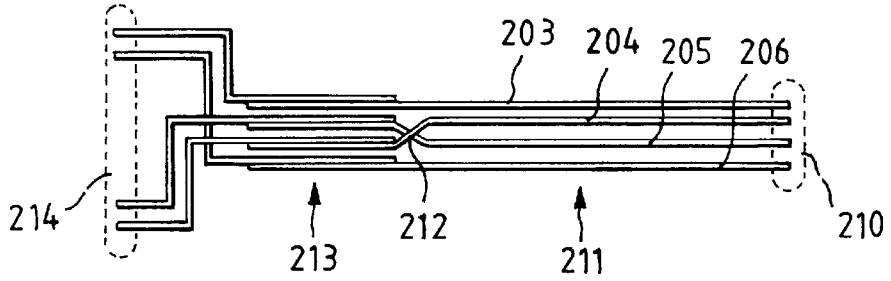
FIG. 9 is an arrangement of the contacts according to FIG. 6 with crossing and compensation.

The contact arrangement for the inner contacts 203, 204, 205, 206 is shown in FIG. 9. To generate the above-described double compensation, the two inner contacts 204, 205 are crossed, with the side-to-side crosstalk zone 211 located to the right of the crossing point 212 and with the compensation zone 213, which forms the first part of the compensation, located to the left of the crossing point 212, while the second compensation area is located in the socket (jack). The contacts 203, 204, 205, 206 also have a low line impedance in the compensation zone 213 compared with the side-to-side crosstalk zone 211, which is embodied, e.g., by different diameters or shapes of the contacts. As a result, there is a predominantly capacitive coupling between the two contact pairs in the compensation zone 213. This coupling compensates the predominant component of the capacitive coupling in the area of the plug/socket (jack) transition, where the non-current-carrying contact ends of the plug and above all of the socket (jack) act capacitively. Due to this measure, the patch plug obtains the necessary good values for the foreign side-to-side crosstalk for this frequency range as well. As an alternative, the measure with the different line impedances may also be placed behind the crossing in the socket (jack) or be divided. However, the embodiment of these capacitances in the punched (punched sheet metal) contacts in the plug can be manufactured more simply than in the socket (jack), whose contacts are made of wire.

Figure 10:
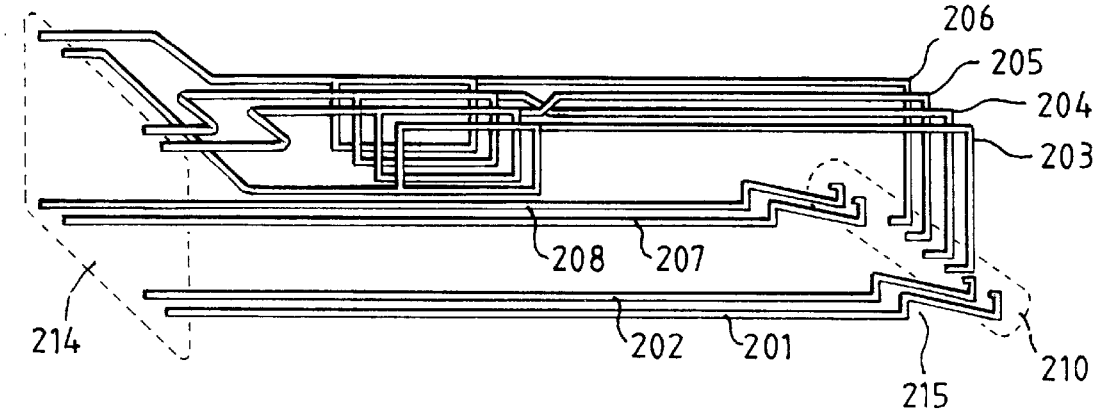
FIG. 10 is a side view of all four contact pairs for the RJ-45 plug.

FIG. 10 shows the complete contact arrangement for the plug. For decoupling between the inner contacts 203, 206, 204, 205 and the outer contacts 201, 202, 207, 208, the outer contacts extend in opposite directions in the contact area 210. As can be clearly seen, the current flows from top to bottom in the outer contacts and from bottom to top in the inner ones. All contacts are made with radii at their contact ends in order to improve the contacting with the opposite contacts of the socket (jack). Directly behind the contact area 210, the outer contacts 201, 202, 207, 208 also have recesses 215, which are used to improve the decoupling from the contacts of the socket (jack). The outer contacts 201, 202, 207, 208 are continued from the contact area 210 to the terminal area 214 in parallel to the inner contacts 203, 206, 204, 205 in another level such that decoupling takes place between the inner and outer contacts. The cables are connected in the terminal area 214 in pairs and by means of a matrix-like 2×2 arrangement, separated in space from one another, so that cable effects due to undefined twisting are weak.

Figure 11:
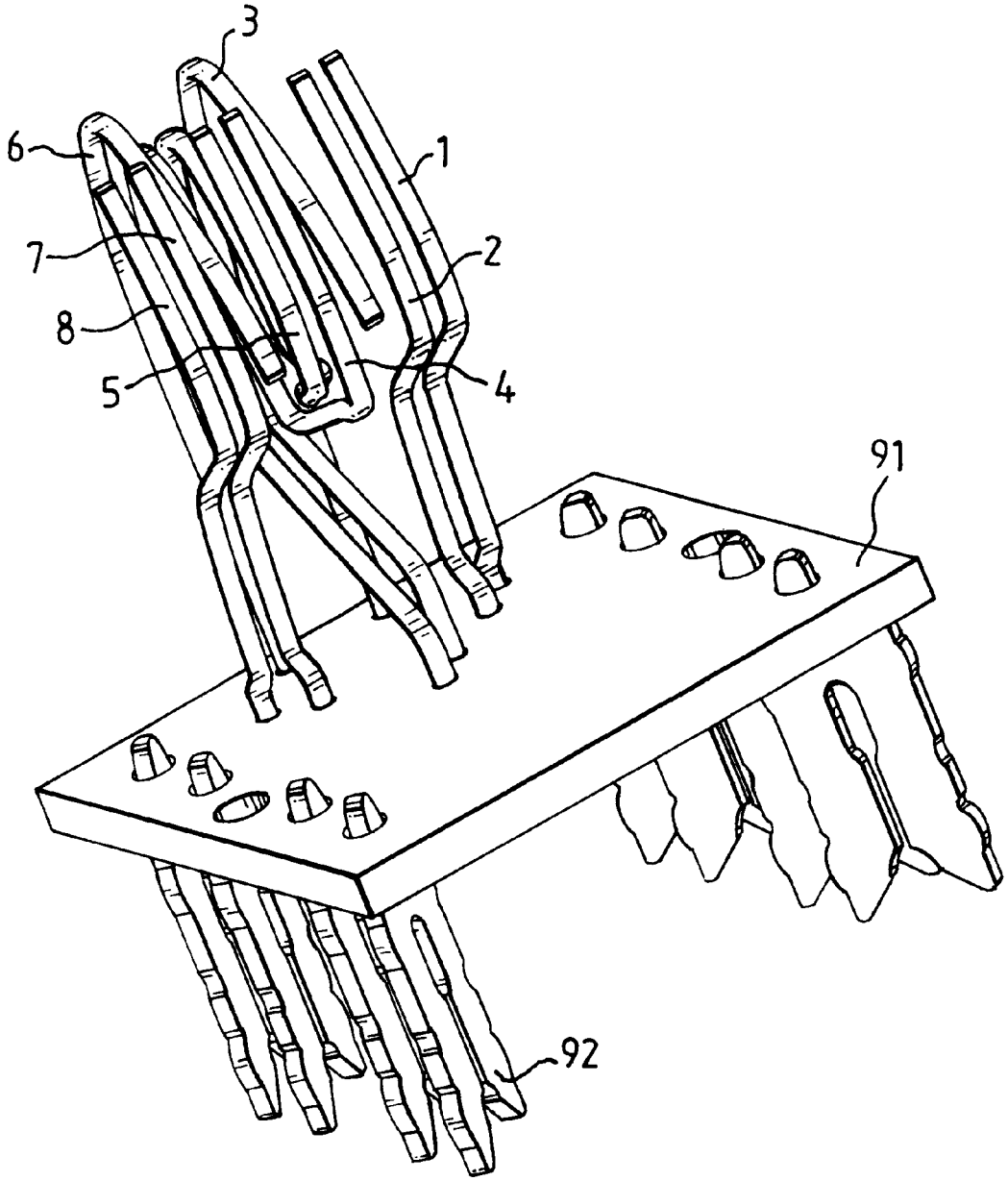
FIG. 11 is a first perspective view of the contact arrangement according to FIG. 5.
Figure 12:
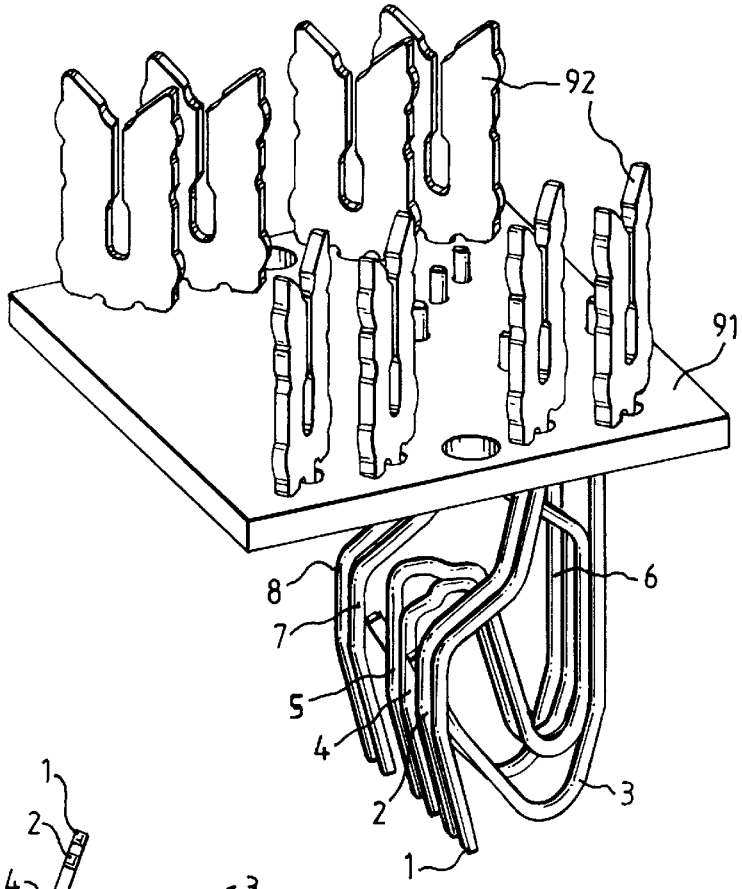
FIG. 12 is a second perspective view of the contact arrangement according to FIG. 5.
Figure 13:
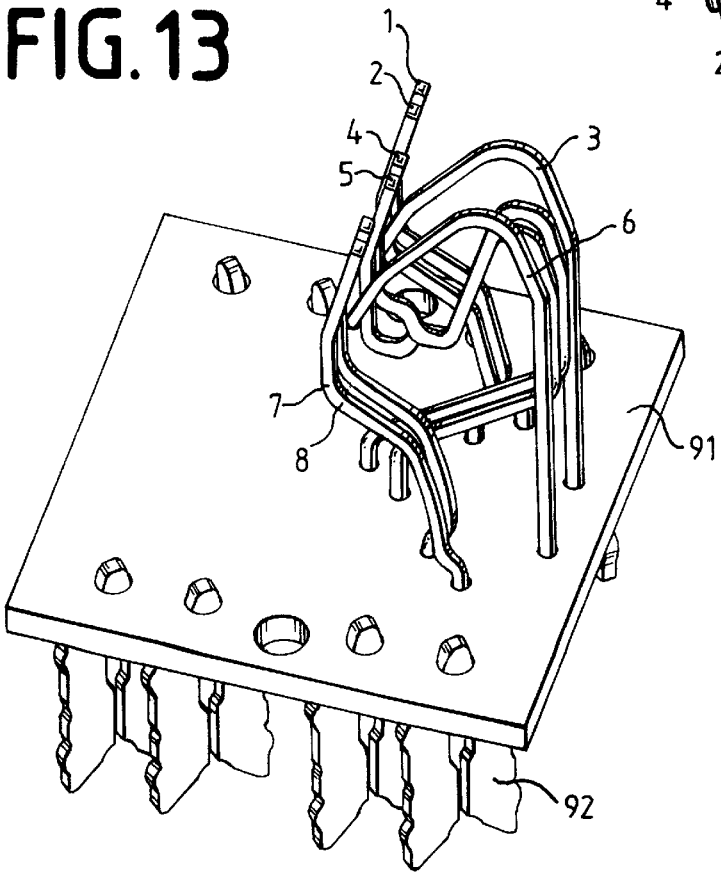
FIG. 13 is a third perspective view of the contact arrangement according to FIG. 5.

FIGS. 11–13 show various perspective views of the contact arrangement for a socket (jack) with a printed circuit board 91 and the assembled insulation displacement contacts 92. The contacts are shown in the non-built-in state, i.e., without socket (jack) body. If the set of contacts is built in in a socket (jack) body, not shown, the eight contacts stand in parallel and are under the necessary pretension. The soldering lands on the printed circuit board for the contacts 1, 2 and 4, 5 and 7, 8 are offset in order to maintain the necessary minimum distance for the creep paths here.

Figure 14:
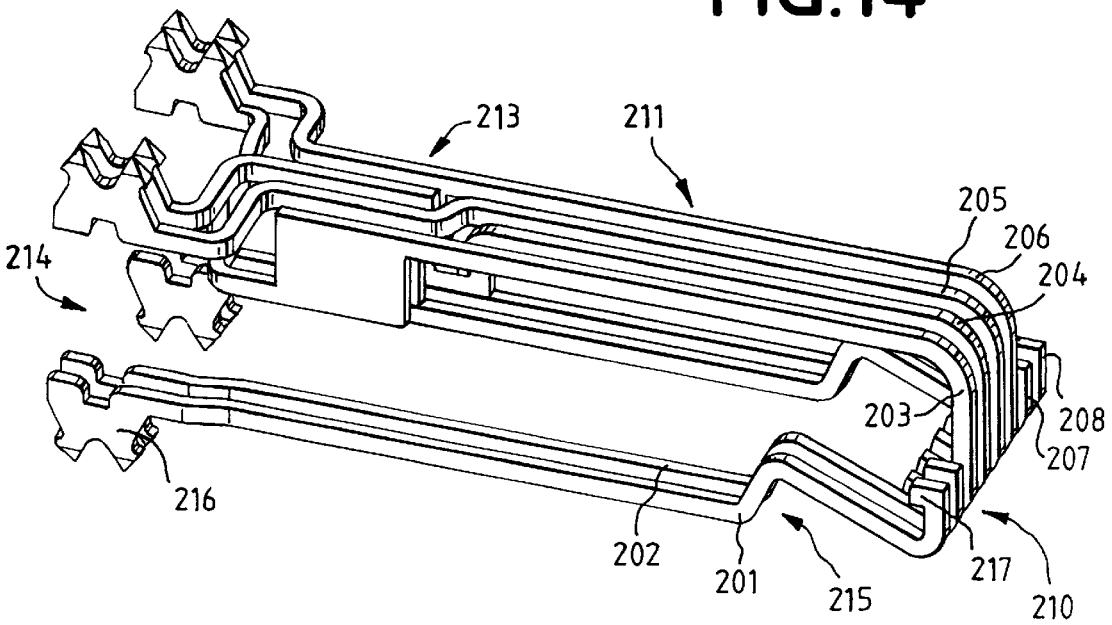
FIG. 14 is a first perspective view of the contact arrangement according to FIG. 10.
Figure 15:
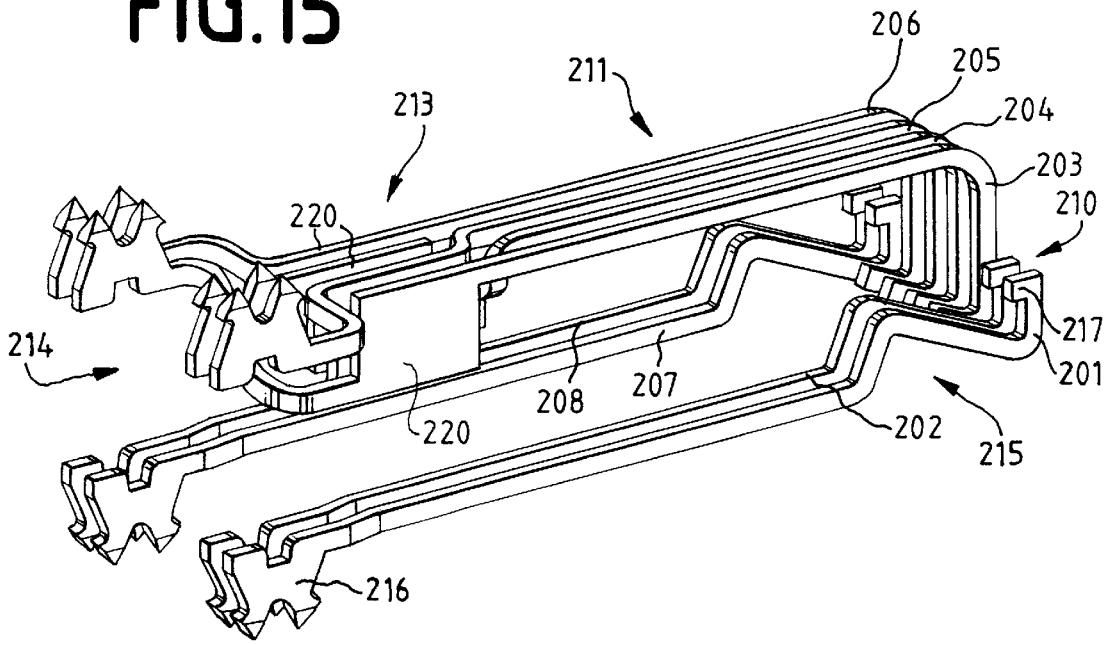
FIG. 15 is a second perspective view of the contact arrangement according to FIG. 10.

FIGS. 14 and 15 show perspective views of the contact arrangement for the plug, wherein the contacts 201–208 are made with penetrating connections 216 in the terminal area 214. The contacts 203–206 of the two contact pairs interlaced with one another are designed as flat contacts 220 (such that there is a predominantly capacitive coupling between the two contact pairs) in the compensation zone 213 in order to reduce the line impedance compared with the side-to-side crosstalk zone 211. The contacts 201–208 are also made with hooks 217 in the contact area 210, which are used for fastening in a plug body, not shown.

While specific embodiments of the invention have been shown and described in detail to illustrate the application of the principles of the invention, it will be understood that the invention may be embodied otherwise without departing from such principles.

What is claimed is:

1. An electric patch plug socket contact pair arrangement, comprising:

socket body with a contact support;

a first contact pair, each first contact pair contact having a terminal area, each first contact pair contact having a contact area, each first contact pair contact being fixed to said contact support and defining a fixedly mounted contact partial area adjacent to said terminal area with each first contact pair contact having a portion mounted in a fixed manner in said fixedly mounted contact partial area and each first contact pair contact having an elastically mounted partial area with the contact being mounted elastically for movement in the socket body;

a second contact pair, each second contact pair contact having a second contact pair terminal area, each second contact pair contact having a second contact pair contact area, each second contact pair contact being fixed to said contact support and defining a fixedly mounted second contact pair contact partial area adjacent to said second contact pair terminal area with each second contact pair contact having a portion mounted in a fixed manner defining a fixedly mounted contact partial area and each second contact pair contact having a second contact pair elastically mounted partial area with the second contact pair contact mounted elastically for movement in the socket body, said second contact pair being disposed between respective contacts of said first contact pair, said contacts of said second contact pair crossing each other to define a crossing point and to position one of said contacts of said second contact pair closer to one of said contacts of said first contact pair at one side of said crossing point and closer to the other of said contacts of said first contact pair at another side of said crossing point and to position the other of said contacts of said second contact pair closer to said other of said contacts of said first contact pair at said one side of said crossing point and closer to said one of said contacts of said first contact pair at said another side of said crossing point, said crossing point being located at the elastically mounted partial area of said contacts of said contacts of said second contact pair.

2. The arrangement in accordance with claim 1, wherein a region of said crossing point is directly adjacent to said contact area.

3. The arrangement in accordance with claim 2, wherein:

said contacts of said second contact pair extend in parallel in said contact area which is in a first partial area;

contacts of said first contact pair extend in parallel to said contacts of said first contact pair in said contact area and extend in a direction which is opposite a direction of extent of said contacts of said second contact pair;

said contacts of said second contact pair change direction by 180° in a second partial area;

said crossing point of said contacts of said second contact pair is in said second partial area;

said contacts of said second contact pair extend from said second partial area, in parallel to said first partial area, in another partial area adjoining said second partial area.

4. The arrangement in accordance with claim 3, wherein:

said contacts of said second contact pair have a further contact adjoining area, adjoining said first partial area, said contacts of said second contact pair being bent in said adjoining area and extending in parallel in a parallel run partial area; and said contacts of said second contact pair have another crossing contact adjoining area, adjoining said another partial area, said crossing contacts being bent in said crossing contact adjoining area and extending in parallel in said parallel run partial area.

5. The arrangement in accordance with claim 4, wherein said crossing contacts are bent off from said parallel run partial area toward said terminal area and are led in parallel in a decoupled position relative to said further contacts.

6. The arrangement in accordance with claim 3, further comprising further contact pairs extending in said contact area in a same direction and in parallel to said contacts of said second contact pair and being bent in or adjacent to said second partial area and extending parallel and being bent again and extending parallel to said parallel run area to said terminal area.

7. A socket for an electric patch plug, comprising a socket body and a set of contacts, wherein said contacts are designed as an arrangement including:

a socket body with a contact support:

at least two contact pairs interlaced with one another, wherein the contacts have a terminal area and a contact area and a fixedly mounted partial area mounted in a fixed manner to said contact support and with said fixedly mounted partial area positioned adjacent to said terminal area and having an elastically mounted partial area mounted elastically in said socket body adjacent to said contact area;

one of said contact pairs being two crossing contacts with a crossing point of said two crossing contacts to provide said two crossing contacts in a crossed position, said crossing point being located in the elastically mounted partial area of the contacts.

8. The arrangement in accordance with claim 7, wherein said crossing point directly joins said contact area.

9. The arrangement in accordance with claim 8, wherein:

said contact area of said crossing contacts extend in parallel in said contact area which is in a first partial area;

the other of said contact pairs interlaced with one another extend in parallel to said crossing contacts in said contact area and in an opposite direction to said two crossing contacts;

said two crossing contacts change direction by 180° in a second partial area;

said crossing point is in said second partial area;

said two crossing contacts extend from said second partial area, in parallel to said first partial area, in another partial area adjoining said second partial area.

10. The arrangement in accordance with claim 9, further comprising:

a further contact adjoining area, adjoining said first partial area, said further contacts being bent in said adjoining area and extending in parallel in a parallel run partial area; and another crossing contact adjoining area, adjoining said another partial area, said crossing contacts being bent in said crossing contact adjoining area and extending in parallel in said parallel run partial area.

11. The arrangement in accordance with claim 10, wherein said crossing contacts are bent off from said parallel run partial area toward said terminal area and are led in parallel in a decoupled position relative to said further contacts.

12. The arrangement in accordance with claim 9, further comprising further contact pairs extending in said contact area in a same direction and in parallel to said crossing contacts and being bent in or adjacent to said second partial area and extending parallel and being bent again and extending parallel to said parallel run area to said terminal area.

13. RJ-45 type patch plug, comprising a plug arrangement of plug contact pairs including at least two plug contact pairs interlaced with one another and arranged in parallel to one another and uncrossed in a contact area, contacts of said plug contact pairs extending from a terminal area to form a defined side-to-side crosstalk zone and a decoupled contact pair zone with contacts of each pair extending in a decoupled position in relation to one another from adjacent to said crosstalk zone to said terminal area; and a socket with a socket body with a contact support and with arrangement of socket contact pairs with at least two socket contact pairs interlaced with one another, wherein each socket contact of said socket arrangement of socket contact pairs is arranged partially in a fixedly mounted partial area and is mounted in a fixed manner adjacent to a terminal area and each contact has an elastically mounted part in an elastically mounted partial area with socket contacts mounted elastically in said socket body adjacent to a contact area, the socket arrangement including a crossing point of two crossing contacts of said contact pairs interlaced with one another to provide said two crossing contacts in a crossed position, said crossing point being located in the elastically mounted partial area of the contacts.

14. The RJ-45 type patch plug in accordance with claim 13, wherein one of a contact length and/or distances between said contacts in the area of said side-to-side crosstalk zone are selected to so as to provide that a greater side-to-side crosstalk becomes established in said crosstalk zone compared with a category 5 plug.

15. The arrangement in accordance with claim 13, wherein two of said plug contacts are crossed between said side-to-side crosstalk zone and said terminal area and form a compensation area.

16. The arrangement in accordance with claim 15, wherein a line impedance of said plug contacts is lower in said compensation area than in said side-to-side crosstalk area and said contacts include a flat region in said compensation area.

17. The arrangement in accordance with claim 13, wherein said side-to-side crosstalk zone of said plug is directly connected to said decoupled zone.

18. The arrangement in accordance with claim 14, wherein a region of said crossing point of said socket is directly adjacent to said socket contact area.

19. The arrangement in accordance with claim 13, wherein said side-to-side crosstalk zone of said plug is directly connected to said decoupled zone and said plug contacts are uncrossed between said contact area and said terminal area.

* * * * *